US005209074A

United States Patent [19]

McConnell et al.

[11] Patent Number: 5,209,074

[45] Date of Patent: May 11, 1993

[54] HIGH EFFICIENCY REFRIGERANT RECOVERY SYSTEM

[75] Inventors: Donald E. McConnell, Charlotte, N.C.; William E. Holland; Mark A. Casey, both of Newark, Del.

[73] Assignee: E. I. du Pont de Nemours & Company, Wilmington, Del.

[21] Appl. No.: 809,948

[22] Filed: Dec. 18, 1991

[51] Int. Cl.[5] ..... F25D 43/04

[52] U.S. Cl. ..... 62/85; 62/475

[58] Field of Search ..... 62/475, 85, 149, 292

[56] References Cited

U.S. PATENT DOCUMENTS

| | | | |
|---|---|---|---|
| 2,246,665 | 6/1941 | Buffington | 62/85 |
| 2,384,860 | 4/1943 | Thomas | 62/119 |
| 2,400,620 | 5/1946 | Zwicki | 62/115 |
| 2,598,799 | 6/1952 | Kiene | 62/475 |
| 2,972,235 | 2/1961 | Smith | 62/475 |
| 3,592,017 | 7/1971 | Lipman et al. | 62/85 |
| 3,699,781 | 10/1972 | Taylor | 62/474 |
| 4,304,102 | 12/1981 | Gray | 62/195 |
| 4,364,756 | 12/1982 | Clarke et al. | 62/85 |
| 4,745,772 | 5/1988 | Ferris | 62/292 |
| 4,856,290 | 8/1989 | Rodda | 62/149 |
| 4,903,499 | 2/1990 | Merritt | 62/149 |
| 4,984,431 | 1/1991 | Mount et al. | 62/85 |
| 4,998,416 | 3/1991 | Van Steenburgh | 62/292 |
| 5,081,851 | 1/1992 | Murray | 62/475 |

*Primary Examiner*—Henry A. Bennet
*Assistant Examiner*—William C. Doerrler
*Attorney, Agent, or Firm*—Bell, Seltzer, Park & Gibson

[57] ABSTRACT

The invention is directed to a process and apparatus for recovering refrigerant from a refrigeration purge stream wherein a gaseous purge stream containing a refrigerant and non-condensible gasses is countercurrently contacted with a high boiling point liquid which absorbs the refrigerant from the purge stream. Preferably a scrubbing column is used to effect countercurrent contact between the purge stream and the liquid stream.

44 Claims, 2 Drawing Sheets

HIGH EFFICIENCY REFRIGERANT RECOVERY SYSTEM

FIELD OF THE INVENTION

This invention relates to a refrigeration purge system and process. More specifically, this invention relates to a refrigeration purge system for the efficient recovery of refrigerant and removal of non-condensible gases within a refrigeration system.

BACKGROUND OF THE INVENTION

Refrigeration systems typically operate by evaporating and condensing a refrigerant to achieve cooling. A wide variety of refrigerants and refrigeration systems are available for private and commercial use, including refrigeration systems using a halocarbon refrigerant.

Typically during a refrigeration cycle, the refrigerant is circulated through an evaporator in which the refrigerant boils at a low temperature to produce cooling. The refrigerant passes from the evaporator to a compressor that increases the pressure and temperature of the gaseous refrigerant and subsequently to a condenser in which the refrigerant discharges its heat to the environment. The refrigerant then flows from the condenser to an expansion valve. Here the refrigerant liquid expands from the high pressure level in the condenser to the low pressure level in the evaporator, and the cycle is completed as the refrigerant returns to the evaporator.

During the course of this cycle, the refrigerant can often become contaminated with a variety of non-condensible gases, including air and water. Such contaminants interfere adversely with the operation of refrigeration systems. When contaminants are present in the system, higher condenser pressures with accompanying increased power costs are required to operate the refrigeration system. Therefore the presence of contaminants in refrigeration systems decrease the efficiency of the operation of such systems. Contaminants in the system also reduce the capacity of refrigeration systems by displacing refrigerant vapor and increasing the pressure against which the compressor must operate in the case of a centrifugal compressor. Further, the presence of such contaminants may lead to the formation of acids resulting in corrosion of internal refrigeration machine components. To counter the effect of such contaminants, purge systems have been developed and incorporated into refrigeration systems to remove or "purge" the non-condensible gases and other contaminants from the system.

Conventional purge systems remove contaminants by directing a small stream of refrigerant vapor, laden with air and other contaminants, into a purge chamber which is separate from the refrigeration condenser and evaporator. Typically a heat transfer coil is used to condense the refrigerant by providing the coil with cold water, air or cooled refrigerant. The refrigerant is condensed within the purge chamber and directed back to the refrigeration machine, and a purge stream of contaminants is discharged to the atmosphere.

The discharge, however, often still contains a substantial amount of refrigerant, which is also discharged to the atmosphere. All purges relying on condensing coils to separate refrigerant from non-condensables suffer several limitations, both physical and practical. Condensing refrigerant from a non-condensible is controlled by temperature and pressure. As temperature is lowered and pressure increased, more refrigerant can be condensed. Practical limitations on producing a cold sink, and pressure limitations resulting from refrigerant breakdown at high pressure limit the amount of refrigerant that can be ultimately removed from a refrigerant-/contaminant mixture. In view of increasing environmental awareness of the effect of some refrigerants on the ozone layer, efforts have increased to reduce the release of these type of compounds into the atmosphere. Further, it would be advantageous economically to separate and reuse the refrigerant to provide a more efficient and cost-effective refrigeration system.

Various means for increasing the efficiency of refrigeration systems have been proposed. For example, U.S. Pat. No. 4,304,102 discloses a refrigeration purging system with a secondary purge chamber for the removal of non-condensible gases. A portion of refrigerant is placed in a first purge chamber with a condensing coil where refrigerant and condensible contaminants such as water are condensed, leaving non-condensible gases such as air and a portion of the refrigerant at the top of the chamber. The refrigerant/non-condensible gas mixture is passed from the first chamber to a second purge chamber with a second condensing coil. Here the remaining refrigerant is condensed and returned to the first purge chamber, and the non-condensible gases are released to the atmosphere. Despite the use of two condensing coils, however, the same limitations that affect the efficiency of a single condenser purge system remain, and thus practically only a limited amount of refrigerant can be removed due to partial pressures exerted by refrigerant/air mixtures.

U.S. Pat. No. 4,984,431 discloses a purge system which includes a purge chamber with a condensing coil. A mixture of refrigerant and non-condensible gases is directed to the purge chamber where the mixture is cooled by the condensing coil. An amount of refrigerant is separated from the non-condensible gases, and the non-condensible gases and remaining refrigerant are routed from the purge chamber to a filter tank. The filter tank is filled with an adsorbent carbon material which adsorbs refrigerant remaining in the mixture. The remaining non-condensibles and refrigerant are then vented to the atmosphere. This system requires the periodic removal and replacement of the carbon material as it becomes saturated.

SUMMARY OF THE INVENTION

The present invention provides an efficient and practical system and process for recovering refrigerant and for removing non-condensible contaminants from a refrigerant-containing purge stream. The system of the invention can be incorporated into existing refrigeration systems and is easily maintained. Further, the invention provides high efficiency removal of refrigerant from non-condensible gases to a level which cannot be achieved by mere condensation alone.

In the invention, refrigerant is removed from a gaseous purge stream by countercurrently contacting the purge stream with a high boiling liquid capable of absorbing the refrigerant. Countercurrent contact is advantageously achieved in a scrubbing column, and preferably a packed column is used to achieve countercurrent contact between the purge stream and the high boiling liquid. Preferably the packed column is a vertically disposed column of relatively small size, e.g., having a diameter of from about 3 inches up to about one-foot, preferably about 6 inches or less and a length of from about 2 feet to up to about 10 feet.

The high boiling point liquid capable of absorbing the refrigerant is advantageously continuously introduced into an upper section of the packed column while the refrigerant-containing purge stream from a refrigeration system is introduced into a lower section of the packed column. Preferably the high boiling point liquid is an inert lubricating oil such as a hydrocarbon oil, an ester, or the like and most preferably is diisooctyl adipate.

The high boiling point liquid and refrigeration purge stream are countercurrently contacted within the packed column so that the refrigerant is absorbed by the high boiling point liquid. Although the high boiling point liquid and the refrigeration purge stream may be contacted by any known means for countercurrently contacting gas and liquid streams, advantageously the contacting means is a structured or woven packing material having a plurality of surfaces.

The mixture of absorbed refrigerant and high boiling point liquid is collected in and recovered from the lower section of the packed column for separation and recovery of the refrigerant. Advantageously a liquid level control means is used to provide removal of the mixture at a rate sufficient to maintain a substantially constant liquid level in the lower section of the packed column. Preferably, a liquid level detecting means, such as a float, a pressure differential sensor, or the like, is connected to a liquid level control valve which drains the mixture from the column at a rate sufficient to maintain a substantially constant liquid level in the lower section of the column. The mixture removed from the column can be directed to a conventional gas/liquid flash separation vessel wherein the refrigerant is separated from the high boiling point liquid by maintaining the pressure of the separation vessel below the vapor pressure of the refrigerant. The pressure of the separation vessel can be maintained by a separate vacuum pump or by the vacuum produced by the refrigeration machine. Preferably a separate mechanical vacuum pump is used to produce the desired vacuum in the flash chamber. Advantageously, after separation, the refrigerant is recycled to the refrigeration system for reuse, and the high boiling point liquid is recirculated to the packed column for further use therein.

The non-condensible gases from the refrigerant-containing purge stream collect in the top of the column. Advantageously the invention also includes means for continuously or periodically releasing the non-condensible gas stream from the top of the packed column. The release means preferably includes a pressure sensing means for determining when a predetermined amount of non-condensible gas stream has collected in the top of the column and a valve means responsive to the pressure sensing means for venting the stream to the atmosphere from the top of the column after the predetermined amount of gas has collected.

BRIEF DESCRIPTION OF THE DRAWINGS

In the drawings, which form a portion of the original disclosure of the invention.

DETAILED DESCRIPTION OF THE PREFERRED EMBODIMENT

Figure 1:
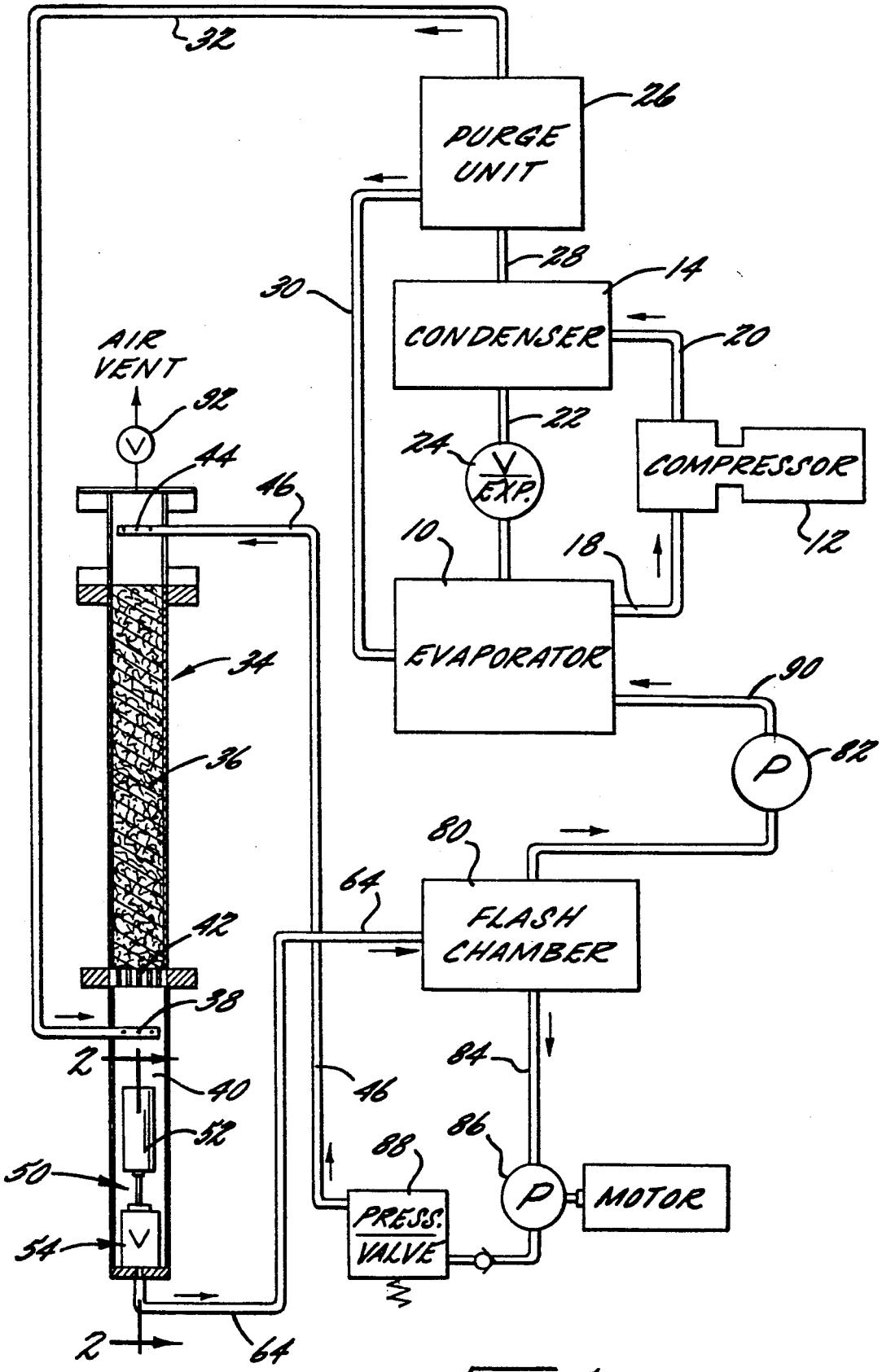
FIG. 1 is a schematic illustration of a preferred purge system of the invention incorporated with a conventional refrigeration system.

FIG. 1 schematically illustrates a purge system and process for the high efficiency recovery of refrigerant from a refrigerant-containing purge stream. A conventional refrigeration system is shown which includes an evaporator 10, a compressor 12, and a condenser 14. Refrigerant is circulated through the evaporator 10 at a suitable pressure where heat is absorbed by the refrigerant, causing it to evaporate. The evaporated refrigerant is discharged from the evaporator 10 through a conduit line 18 to the suction of the compressor 12. There the pressure of the refrigerant is raised, and the refrigerant, now under higher pressure, passes to the condenser 14 via conduit 20. Here the refrigerant is condensed, releases heat, and exits the condenser under pressure along conduit 22 to an expansion device 24. The expansion device provides for expansion of the refrigerant to a lower pressure and temperature, and the refrigerant returns to the evaporator 10 to complete the cycle. The expansion device may be any device known in the art for high-side float valves, thermostatic expansion valves, capillary tubes, or the like.

During operation or maintenance, various non-condensible gases and other contaminants collect within the refrigeration system, normally accumulating at the top of the condenser. To purge the system of the contaminants without losing refrigerant, it is necessary to separate the refrigerant from the contaminants. A primary purge unit 26 is provided to condense the majority of refrigerant from the refrigerant/contaminant mixture. The purge unit 26 is connected to the upper part of the condenser 14 by a conduit line 28 through which the gaseous mixture of refrigerant and contaminants are extracted from the condenser 14 to the purge unit 26. The purge unit 26 can be any known to those skilled in the art, including those units which are standard on many refrigeration systems and which are available commercially. Advantageously the purge unit 26 contains a condensing coil which operates to cool the purge stream of refrigerant and non-condensible gases so that a portion of the refrigerant is condensed and separated from the non-condensible gases. The condensing coil is cooled by a cool liquid, such as refrigerant supplied and expanded from the condenser, which is circulated through the coil.

A portion of the refrigerant is thus separated from the purge stream and collects in a lower portion of the purge unit 26. The level of condensed refrigerant in the purge unit 26 is regulated so that when the level reaches a predetermined level, it is drawn off from the unit and passed along line 30 back to the evaporator 10. The non-condensible gases collect at the top of the purge unit. Water may also be present and can be drawn off from the unit in any of the conventional ways known in the art.

During the condensing operation of the purge unit 26, a portion of refrigerant is separated from the gaseous mixture entering the unit. Typically, however, a substantial amount of refrigerant which has not been condensed still remains in the gaseous mixture in the purge unit.

The gaseous mixture of non-condensible gases and refrigerant collects at the top of the purge unit 26. Typically, the purge unit is maintained at a positive pressure. The pressure can be monitored by a sensor [not shown] and at a predetermined pressure, a valve operates to release the gaseous mixture into conduit 32 at the top of the unit 26. In a preferred embodiment, the primary or condensing purge is operated continuously, and the gaseous mixture of refrigerant and contaminants is fed by virtue of the positive pressure in the purge unit more or less continuously through conduit 32 to a packed column 34.

The conduit 32 leads from the top of the purge unit 26 to a packed column 34. The packed column 34 contains a plurality of surfaces as indicated by a packing material 36. The column 34 is preferably a vertically disposed column, but a horizontally disposed column can also be used in the invention. The packed column can be any of the types known used for gas-liquid contacting and for absorption operations, and is described in more detail below.

Gas conduit 32 passes the gaseous mixture from the first purge unit 26 to a lower section of the column 34. A gas inlet 38 is located along the lower section of the column at a point above a liquid collecting section 40 within the lower section of the column 34. The gas inlet 38 allows entry of the gaseous mixture from the first purge unit 26 and conduit 32 into the column 34. As described above, a condenser in a refrigeration system typically operates under a positive pressure of about 5–50 psig, depending on the type of refrigerant and on the desired degree of refrigeration, so that the gaseous mixture collected and released from the condenser to the purge unit 26 and ultimately to the gas mixture conduit line 32 is also supplied at a positive pressure. The column 34 can thus advantageously be maintained at close to atmospheric pressure, although it will be recognized that the pressure of the incoming gaseous mixture from the refrigeration system and of the column 34 of the invention may vary, depending upon the specific refrigeration system and column employed.

The packing material 36 is supported by a perforated support plate 42 and occupies approximately 60 to 80% of the height of the column 34. As the gaseous mixture enters the column 34 through the gas inlet 38, it flows upwardly through the support plate and into the bed of the packing material 36.

A second inlet 44 is provided in a top section of the column 34. A high boiling point liquid is introduced through line 46 into the top section of the column 34 via the second inlet 44. The high boiling point liquid is distributed by a distributor, and the high boiling point liquid flows downwardly in countercurrent relationship to the upwardly flowing gaseous mixture rising from the lower section of the column 34. The flow rate of the high boiling point liquid can be varied depending on the flow rate of the purge stream and the composition of the high boiling liquid as will be apparent. Typically the high boiling liquid is passed through the column at a rate of from about 50 to 150 pounds per hour.

The high boiling point liquid can be any liquid which is capable of absorbing the refrigerant from the gaseous mixture. Preferably, the high boiling point liquid is a chemically inert, low viscosity liquid having a substantially insignificant vapor pressure at ambient temperature, such as a lubrication oil, a hydrocarbon ester or a substituted hydrocarbon ester such as an alkyl ester of a fatty acid. A particularly preferred liquid is diisooctyl adipate. As the high boiling point liquid flows downwardly in a counter-current relationship to the gaseous stream, the liquid absorbs at least a portion of the refrigerant in the mixture, thus reducing the amount of refrigerant in the gaseous mixture.

The packing material 36 in the column 34 provides high surface area contact between the high boiling point liquid and the gaseous mixture to maximize the absorption of refrigerant. The packing material 36 is preferably inert under the operating conditions employed. Any packing material which provides high surface area for contacting the gaseous mixture with the high boiling point liquid can be used, and such materials are known to those skilled in the art. Preferably, woven packings are used. Woven packings are preferred to random packings such as Pall Rings, Berl saddles, Raschig Rings or structured sheet metal or sheet mesh packings and the like, due to their ability to impact greater surface area in a given volume, although random packings and structured packings can be readily employed in this invention. Any trayed column, such as an oldershaw or sieve plate column, can also be used in the invention Woven packings of any sort may be used in the invention. Typical woven packings include Goodloe packing, Koch-Sulzer packing, Neo Koss packing, Leva film trays packing, and the like. Advantageously the woven packing used is Goodloe packing. This packing is typically made of 0.0045 in. diameter wires, with 12 strands being knitted together to form a tube. The tube is flattened to make a double-thickness ribbon approximately 6 inches wide. This ribbon is crimped, the creases of the crimping being at an angle to the centerline of the ribbon. The ribbons are then arranged in reversed relationship so that the creases cross each other, thereby determining the spacing of the adjacent ribbons. The two ribbons are rolled together until a cartridge is formed having enough layers to provide a diameter to fit the column snugly.

Another woven packing which can advantageously be used in the invention is a Koch-Sulzer packing. Using this type of packing, cylindrical or segmental packing sections are formed from parallel corrugated scrubs of woven-wire fabric. The corrugations are inclined with respect to the tower axis, and the direction of the corrugations is reversed on the adjacent scrubs. Two groups of parallel, crossed-flow passages of triangular shape are thus formed between adjacent scrubs. The packing sections, which are about 6.7 inches thick, are stacked in the shell to the required height. Each successive section is rotated 90 degrees.

Preferably the packing of the invention is Goodloe packing or Koch-Sulzer packing, and most preferably is Goodloe packing. The height of the column 34 is dependent on the amount of separation desired and the diameter of the column 34 is dependent on the pressure drop desired through the column, which is in turn dependent on the flow rate of the high boiling point liquid and vapor through the packing. Advantageously the column 34 is a cylindrical column having a packed length of from about 1 foot to about 6 feet, and preferably from about 2 feet to about 4 feet. Due to practical limitations such as channeling effects, the diameter of the column 34 is advantageously from about 2 to about 6 inches, and preferably from at least about 3 to about 4 inches.

The high boiling point liquid which exits the packing material contains absorbed refrigerant. Preferably the refrigerant containing liquid collects in a liquid collecting section 40 of the column 34 and exits the column 34 to conduit 64 at a rate determined by a liquid level control means 50. Preferably liquid level control means 50 includes a valve which is capable of opening against the force of a vacuum and provides for the substantially continuously variable release of the liquid in order to maintain the collected liquid at a substantially constant level.

Figure 2:
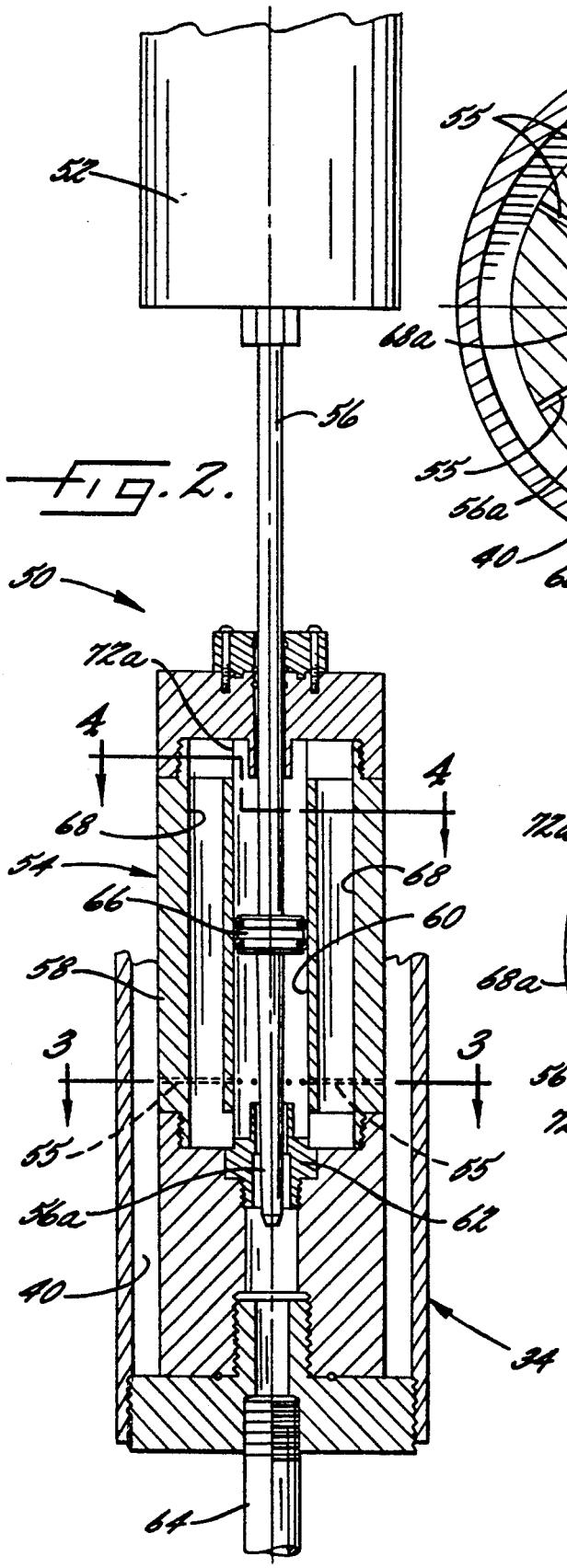
FIG. 2 is a longitudinal cross-sectional view of a liquid level control means of the purge system of FIG. 1 along line 2—2.
Figure 3:
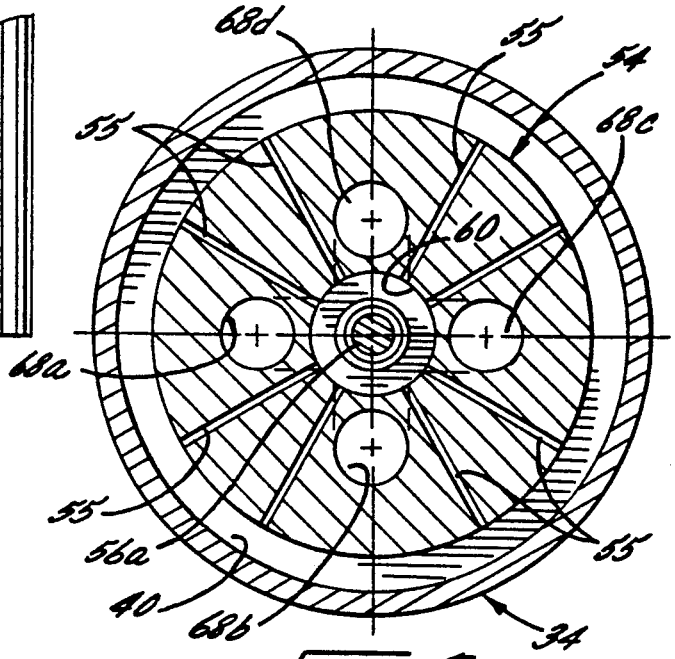
FIG. 3 is a cross-sectional view of a liquid level control valve of FIG. 2 along line 3—3.
Figure 4:
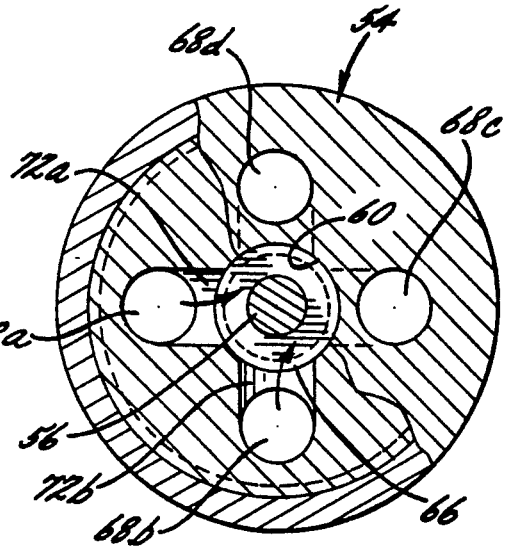
FIG. 4 is a partially broken cross-sectional view of the valve of FIG. 2 along line 4—4.

FIGS. 2, 3 and 4 illustrate a preferred embodiment of liquid level control means 50. Referring in particular to FIG. 2, FIG. 2 is a longitudinal cross sectional view of liquid level control means 50 taken along line 2—2 of FIG. 1. In FIG. 2, liquid level control means 50 comprises a liquid level detecting means 52 in the form of a cylindrical float and a variable flow rate liquid level control valve 54. Although shown in FIG. 2 as a float, the liquid level detecting means 52 may be any device known in the art for detecting the level of a liquid, including pressure differential sensors, or the like.

As shown in FIG. 2, the liquid level control valve 54 comprises a housing 58 having a central bore 60. A stem 56 is connected to float 52 and extends downwardly from float 52 into central bore 60 to an orifice insert 62, which is sized to receive a lower end 56*a* of stem 56. As best shown in FIG. 3, there are a plurality of small diameter ports, 55, which communicate from the exterior to the interior of the valve housing for allowing liquid to enter into the central bore 60 of the valve. The liquid collected in the lower portion of column 34 thus enters into the central bore 60 of the valve via ports 55 and is released through orifice insert 62 to a conduit 64.

A guide member 66 is provided about a portion of the stem 56 and is slidably located within the central bore 60. Advantageously, a portion of the stem 56 is tapered so that the lower portion of stem 56 below guide member 66 tapers continuously from a larger to a smaller diameter in the direction away from guide 66. As the liquid level rises and falls within the lower section of the column 34, float 52 rises and falls, causing, in turn, the lower tapered portion of stem 56 to move upwardly and downwardly within orifice insert 62, thereby continuously varying the size of the annular space between the stem and the orifice insert. This in turn varies the rate of release of the collected liquid mixture into conduit 64. The guide member 66 is positioned on the stem 56 at a location such when the liquid level in the column is below a predetermined height, the guide member seals the orifices 55 thus closing the valve.

The valve 54 is specially adapted to be capable of opening to allow release of the liquid mixture from the column 34 to conduit 64 against the force of a vacuum typically present in conduit 64. As illustrated in FIG. 3, the central bore of the liquid level control valve 60 is encircled by a plurality of outer bores or ports, 68*a*, 68*b*, 68*c*, and 68*d* which are larger in diameter than the liquid entry ports 55. Each of the outer ports 68 are fluidly connected at the upper and lower end with the central bore 60 so that the pressure differential above and below the guide member 66 is equalized. These openings, best illustrated in FIG. 4 as 72*a* and 72*b*, are provided at the upper and lower portions of each of the peripheral bores 68*a*, 68*b*, 68*c*, and 68*d*. The openings 72*a* and 72*b* provide for fluid communication between the exterior ports and the central port as indicated generally by the arrows in the broken cross-sectional aspect of FIG. 4. The openings thus provide a means for maintaining an equalized pressure, both above and below the guide member 66 thereby allowing the valve to readily open against the force of vacuum.

In operation, as the level of liquid rises in the lower portion of column 34, float 52 also rises, thereby moving the stem 56 upwardly within the orifice insert 62. In turn, the opening about the lower tapered end of stem 56 within orifice insert 62 is enlarged, and liquid is released at a faster rate. As the liquid level in the lower portion of column 34 lowers, float 52 also lowers, thereby downwardly moving the stem 56 back into the orifice 62. In turn the opening provided about the lower tapered end of stem 56 is reduced and correspondingly the rate of liquid release is also reduced. By continuously varying the rate of liquid release as a function of the level of the liquid collected in the column, valve 54 maintains the liquid level in the lower portion of column 34 at a relatively constant height.

Although it is preferred to use a liquid level control system which maintains a substantially constant liquid level in the bottom portion of the column, other less precise valves and liquid control arrangements which allow greater fluctuation in the liquid level can also be employed in the invention. Such arrangements include fixed restriction such as orifices and capillary tubes from releasing liquid at a predetermined flow rate. In addition, although the liquid level control system of FIGS. 2–4 is internally contained within the scrubbing column for minimizing any possible air leakage into the column externally mounted and externally controlled liquid, level control valves can also be used in the invention.

Referring back to FIG. 1, the liquid mixture passes from the liquid collecting section of the column through the valve 54 into a liquid conduit line 64. The liquid mixture is directed along the liquid conduit line 64 to a gas/liquid flash separation chamber 80, where the refrigerant is separated from the high boiling point liquid. The pressure of the flash chamber 80 is maintained below the boiling point pressure of the refrigerant, e.g., from about 26 to 29 inches Hg vacuum in the case of refrigerant-11, by a mechanical vacuum pump 82. While any type of vacuum pump may be used in the invention, advantageously the vacuum pump 82 is a diaphragm pump. The thermodynamic conditions, e.g. low pressure, within the flash chamber 80 are advantageously sufficient to cause substantially all of the absorbed refrigerant to be rapidly removed from the liquid mixture as a vapor.

The flash chamber 80 can be either horizontal or vertical, so long as the chamber provides sufficient volume either through diameter and/or height to allow the refrigerant vapor velocity leaving the flasher to be low. This inhibits entrainment of small drops of the high boiling liquid that can form when the refrigerant bubbles explosively leave the liquid mixture. Additionally, a knitted mesh pad can be inserted into the flash chamber to ensure that all of the high boiling liquid is captured.

The flash chamber 80 should also provide sufficient volume to hold a reservoir of the high boiling liquid so that it can be recirculated back to the column 34. The high boiling point liquid collects in the bottom of the flash chamber 80 and drains from an outlet in the bottom of the flash chamber along a conduit 84 to a pump 86. Advantageously the pump 86 is magnetically geared, although any pump known in the art may be used in the invention. The pump 86 pumps the high boiling liquid through a flow regulating valve 88 and along the conduit 46 back to the inlet 44 located at the upper portion of the column 34. The high boiling point liquid is thus recirculated to the column for reuse in the absorption of refrigerant.

The liberated refrigerant collects as a vapor at the top of the flash chamber 80. Advantageously the refrigerant is returned by the vacuum pump 82 along conduit 90 to the evaporator 12 to be reused in the refrigeration system.

Although a vacuum pump is shown in the drawing for decreasing the pressure in the flash chamber, the vacuum in the flash chamber 80 can alternatively be provided by the refrigeration system compressor. In such an embodiment of the invention, the separate vacuum pump 82 can be eliminated.

Non-condensible gases are collected at a top portion of the column 34. Advantageously, a valve 92 regulates the pressure at the top of column 34 and the release of non-condensible gases. Valve 92 may be any conventional back-pressure regulating valve responsive to conventional pressure sensing means, such as a continuously acting pressure controlling valve controlled by a conventional pressure sensing device consisting of a diaphragm sensing element, transducer and electronic control; a solenoid valve actuated periodically by any commercially available device known generically as a pressure switch, and the like. The pressure in the top of the column increases as non-condensible contaminants accumulate. When the pressure increases to a predetermined pressure, the valve 92 is actuated to release the non-condensibles to the atmosphere. Preferably, the valve 92 is actuated at a pressure from about 1 psig to about 10psig, more preferably at a pressure of about 2 psig to about 4 psig.

The mixture released to the atmosphere typically contains from about 0.10 to about 0.01 pounds of refrigerant per pound of non-condensible gases. Thus greater than about 90% of the refrigerant can be removed from the purge stream with the invention, and preferably at least about 95%, and most preferably at least about 99%, of the refrigerant is removed from the purge stream. The invention may be used with any refrigerant including halocarbons, and particularly fluorocarbons and chlorofluorocarbons, such as trichloromonofluoromethane (R-11), dichlorodifluoromethane (R-12), dichloroethane (R-123), trichlorotrifluoroethane (R-113), dichlorotetrafluoroethane (R-114), tetrafluoroethane (R-134A) and the like.

The invention as illustrated in the drawing and described previously is susceptible to numerous advantageous variations and modifications. For example, although the refrigerant recovery system of the invention as shown is attached to the conventional purge unit of a refrigeration system, the conventional purge can be eliminated and the system of the invention can be attached directly to the condenser of the refrigeration system. In addition, various known countercurrent scrubbing columns and systems can be substituted for the scrubbing column illustrated in the drawing. Moreover, heating or cooling means can readily be added to the scrubbing column to improve scrubbing of the refrigerant from the purge stream. Similarly, other known gas liquid separation systems can be substituted for the flash separator discussed previously. For example, in one embodiment, a distillation column is substituted for flash separation device 80 to remove the absorbed refrigerant. The oil may be heated and cooled to aid recovery of the absorbed refrigerant from the higher boiling point liquid for either flash separation device 80 or a packed column.

The refrigerant recovery system of the invention can be integrally incorporated into any of various refrigeration systems such as air conditioning systems, industrial refrigeration systems and the like. Alternatively the recovery system of the invention can readily be provided in modular form as a retrofit upgrade for existing air conditioning and refrigeration systems.

The invention has been described in considerable detail with reference to its preferred embodiments. However, it will be apparent that numerous variations and modifications can be made without departure from the spirit and scope of the invention as described in the foregoing detailed specification and defined in the appended claims.

What is claimed is:

1. An apparatus for removing non-condensible gases from a refrigerant purge stream comprising:

a scrubbing column;

means for introducing a refrigerant-containing purge stream from a refrigeration system into a lower section of said scrubbing column;

means for introducing a high boiling point liquid capable of absorbing said refrigerant into an upper section of said scrubbing column;

means for recovering a mixture of said refrigerant and said high boiling point liquid from a lower section of said scrubbing column; and means for venting non-condensible gasses received in an upper section of said scrubbing column to the atmosphere.

2. The apparatus according to claim 1 wherein said scrubbing column is from about 2 inches to about 1 foot in diameter.

3. The apparatus according to claim 2 wherein said scrubbing column is about 2 feet to about 10 feet in height.

4. The apparatus according to claim 1 wherein said scrubbing column is vertically disposed.

5. The apparatus according to claim 1 wherein said scrubbing column comprises a packing material having a plurality of surfaces to facilitate the intimate countercurrent contact of said liquid and said purge stream.

6. The apparatus according to claim 5 wherein said packing material comprises a woven material.

7. The apparatus according to claim 1 wherein said high boiling point liquid comprises a lubrication oil.

8. The apparatus according to claim 1 wherein said high boiling point liquid is diisooctyl adipate.

9. The apparatus according to claim 1 wherein said means for recovering the mixture of high boiling point liquid and refrigerant comprises control means for controlling the level of said mixture within the lower section of said column.

10. The apparatus according to claim 9 wherein said control means comprises:

detecting means for detecting the level of said mixture in said column; and valve means responsive to said detecting means for releasing said mixture from the column at a variable rate.

11. The apparatus according to claim 10 wherein said detecting means is a float.

12. The apparatus according to claim 10 wherein said valve means comprises:

a housing having a central bore encircled by a plurality of peripheral bores;

a stem connected at an upper portion of thereof with said float and extending downwardly from said float into said central bore;

an orifice positioned at a lower portion of said housing for receiving a lower end of said stem; and a guide member attached to said stem and being slidably positioned within said central bore at a point above said orifice, and wherein said upper portion of the central bore is fluidly connected with said lower portion of the central bore via passages positioned at opposing ends of each of said peripheral bores and in communication with said central bore.

13. The apparatus according to claim 12 wherein said stem tapers from a larger to a smaller diameter from an upper to a lower portion thereof.

14. The apparatus according to claim 1 wherein said means for venting non-condensible gases comprises:

pressure sensing means for determining when a predetermined amount of non-condensible gas has collected in the top of the column; and valve means responsive to said pressure sensing means for venting said non-condensible gas to the atmosphere from the top of the column after said predetermined amount of gas has collected.

15. The apparatus according to claim 14 wherein said valve means is a solenoid actuated valve.

16. The apparatus according to claim 1 further comprising means downstream of said scrubbing column for separating refrigerant from said mixture of refrigerant and high boiling point liquid.

17. The apparatus according to claim 16 wherein said gas/liquid separation means comprises a flash separation unit maintained at a thermodynamic condition sufficient for separating a substantial amount of the refrigerant from said mixture.

18. The apparatus according to claim 17 further comprising a vacuum pump for maintaining said thermodynamic condition in said gas liquid separation zone.

19. The apparatus according to claim 18 wherein said vacuum pump is a diaphragm pump.

20. The apparatus according to claim 16 further comprising means for recirculating said high boiling point liquid from the separation unit to the scrubbing column.

21. The apparatus according to claim 20 wherein said recirculating means comprises:

a valve for removing said high boiling point liquid from a lower portion of the separation unit; and a pump for recirculating the high boiling point liquid removed from said separation unit to said upper section of the scrubbing column.

22. The apparatus according to claim 16 further comprising means for recycling said refrigerant to said refrigeration system.

23. An apparatus for removing non-condensible gases from a refrigerant purge stream comprising:

a vertically disposed scrubbing column;

means for introducing a high boiling point liquid into an upper section of said scrubbing column;

means for introducing a refrigerant-containing gaseous purge stream from a refrigeration system into a lower section of said scrubbing column;

contacting means for countercurrently contacting the high boiling liquid and refrigerant-containing purge stream in the scrubbing column so that the refrigerant is absorbed by the high boiling point liquid, said contacting means comprising a woven packing material having a plurality of surfaces;

detecting means for detecting the level of the high boiling point liquid/refrigerant mixture in the lower section of said column;

valve means responsive to said detecting means for releasing said liquid from the column at a rate sufficient to maintain a substantially constant height of said liquid in the lower section of the column; and means for releasing non-condensible gas from the top of said distillation column.

24. A purge system for removing non-condensible gases from a refrigerant in a refrigeration system comprising:

a first purge means for removing refrigerant from a refrigerant-containing purge stream; and a second purge means for receiving the refrigerant-containing purge stream from said first purge means;

wherein said second purge means comprises means for counter-currently contacting said purge stream with a high boiling point liquid capable of absorbing said refrigerant and means for venting non-condensible gasses to the atmosphere.

25. A purge system for removing non-condensible gases from a refrigerant in a refrigeration system comprising a receiving means for receiving a refrigerant-containing gaseous purge stream from said refrigeration system, means for countercurrently contacting said purge stream with a high boiling point liquid capable of absorbing said refrigerant, means for venting non-condensible gasses to the atomsphere, and separating means for separating refrigerant from a mixture of said refrigerant and said high boiling point liquid.

26. A process for removing non-condensible gases from a refrigerant in a refrigeration system, the process comprising:

introducing a gaseous stream including refrigerant and non-condensible gases from a refrigeration system into a lower section of a scrubbing zone;

introducing a high boiling point liquid capable of absorbing said refrigerant into an upper section of said scrubbing zone;

flowing said high boiling point liquid downwardly through said scrubbing zone in countercurrent relationship to said gaseous stream so that at least a portion of the refrigerant is absorbed by said high boiling point liquid;

recovering a mixture comprising refrigerant and high boiling point liquid from a lower section of said scrubbing zone; and removing a non-condensible gas stream from the top of said scrubbing zone.

27. The process according to claim 26 wherein said scrubbing zone comprises a packing material having a plurality of surfaces.

28. The process according to claim 27 wherein said packing material comprises a woven packing material.

29. The process according to claim 26 wherein said scrubbing zone is defined by a vertically disposed packed column.

30. The process according to claim 26 wherein said high boiling point liquid is a lubrication oil.

31. The process according to claim 30 wherein said high boiling point liquid is diisooctyl adipate.

32. The process according to claim 26 wherein said high boiling point liquid absorbs at least about 90 wt. % of the refrigerant from said gaseous stream.

33. A process according to claim 26 wherein said high boiling point liquid absorbs at least about 95 wt. % of the refrigerant from said gaseous stream.

34. The process according to claim 26 wherein said high boiling point liquid absorbs at least about 99 wt. % of the refrigerant from said gaseous stream.

35. The process according to claim 26 wherein the step of recovering the mixture comprising refrigerant and high boiling point liquid from a lower section of the scrubbing zone comprises:

removing said mixture from said scrubbing zone at a variable rate sufficient to maintain a substantially constant height of liquid in the lower portion of said scrubbing zone.

36. The process according to claim 26 wherein the step of removing the non-condensible gas stream comprises continuously venting the stream to the atmosphere.

37. The process according to claim 26 wherein the step of removing the non-condensible gas stream comprises:

detecting when a predetermined amount of non-condensible gas stream has been collected in an upper portion of said scrubbing zone; and venting the stream to the atmosphere in response to said detecting step.

38. The process according to claim 26 wherein said non-condensible gas stream comprises less than about 0.10 pounds of refrigerant per pound of non-condensible gases.

39. The process according to claim 26 further comprising the step of separating the refrigerant from said mixture comprising refrigerant and high boiling point liquid.

40. The process according to claim 39 wherein said separating step comprises:

directing said mixture from the lower section of the column to a gas/liquid separation zone; and maintaining the temperature and pressure conditions within said gas/liquid separation zone sufficient to effect removal of a substantial amount of the refrigerant from said mixture in gaseous form.

41. The process according to claim 39 further comprising the step of removing said high boiling point liquid from a lower portion of the separation zone and directing said liquid to the upper section of said scrubbing zone.

42. The process according to claim 40 further comprising the steps of collecting refrigerant vapor from an upper portion of the separation zone and directing said vapor to the refrigeration system.

43. A process for removing non-condensible gases from a refrigerant in a refrigeration system, the process comprising:

introducing a gaseous stream including refrigerant and non-condensible gases from a refrigeration system into a lower section of a vertically disposed scrubbing column comprising a plurality of contacting surfaces;

introducing a high boiling point liquid capable of dissolving said refrigerant into an upper section of said column;

flowing said high boiling point liquid downwardly through said column in countercurrent relationship to said gaseous stream so that at least about 90 wt. % of the refrigerant is absorbed by said high boiling point liquid;

recovering a mixture comprising refrigerant and high boiling point liquid from a lower section of said column; and removing a non-condensible gas stream from the top of said column.

44. A process for removing non-condensible gases from a refrigerant in a refrigeration system, the process comprising:

introducing a gaseous stream including refrigerant and non-condensible gases from a refrigeration system into a lower section of a vertically disposed scrubbing column comprising a plurality of contacting surfaces;

introducing a liquid comprising a high boiling alkyl ester into an upper section of said column;

flowing said liquid downwardly through said column in countercurrent relationship to said gaseous stream under condition such that at least about 95 wt. % of the refrigerant is absorbed by said liquid;

recovering a mixture of said liquid and refrigerant from a lower section of said column;

directing said mixture from the lower section of the column to a gas/liquid separation zone maintained at a thermodynamic condition sufficient for separating said refrigerant from said mixture;

separately recovering said refrigerant and said high boiling point liquid from said separation zone;

recycling said high boiling point liquid from said separation zone to said upper section of said column; and removing a gaseous stream from an upper section of said column.

* * * * *

UNITED STATES PATENT AND TRADEMARK OFFICE

CERTIFICATE OF CORRECTION

PATENT NO. : 5,209,074

DATED : May 11, 1993

INVENTOR(S) : McConnell et al.

It is certified that error appears in the above-identified patent and that said Letters Patent is hereby corrected as shown below:

Title page of the patent under "References Cited":

"2,400,620 5/1946 Zwicki ..... 62/115" should be
-- 2,400,620 5/1946 Zwickl ..... 62/115 --.

Column 4, line 28 after "for" and before "high-side" please add
-- reducing pressure of the refrigerant, such as lower or --.

Signed and Sealed this

Twenty-ninth Day of March, 1994

*Attest:*

Bruce Lehman

BRUCE LEHMAN

*Attesting Officer*

*Commissioner of Patents and Trademarks*